United States Patent [19]

Fusi et al.

[11] Patent Number: 4,900,287

[45] Date of Patent: Feb. 13, 1990

[54] TEARING EYE DOLL

[75] Inventors: John C. Fusi, New Providence; Robert M. Jensen, Bloomfield, both of N.J.

[73] Assignee: View-Master Ideal Group, Inc., New York, N.Y.

[21] Appl. No.: 377,264

[22] Filed: Jul. 10, 1989

[51] Int. Cl.[4] ..... A63H 3/24; A63H 3/38

[52] U.S. Cl. ..... 446/183; 446/305; 446/389

[58] Field of Search ..... 446/183, 197, 306, 305, 446/304, 392, 389

[56] References Cited

U.S. PATENT DOCUMENTS

| | | | |
|---|---|---|---|
| 2,812,615 | 11/1957 | Zanca et al. | 446/306 X |
| 3,070,921 | 1/1963 | Baggott et al. | 446/306 X |
| 3,789,539 | 2/1974 | Cagen | 446/306 |
| 3,855,729 | 12/1974 | Sapkus et al. | 446/306 X |

*Primary Examiner*—Mickey Yu
*Attorney, Agent, or Firm*—Michael Ebert

[57] ABSTRACT

A tearing eye doll having a pair of synthetic eyes, each formed by an eye-shaped porous block whose face simulates the white of a human eye, and an impermeable disc seated in a recess in the face and colored to simulate an iris and a pupil therein. Received in a cavity within the block behind the disc is a nozzle for injecting water into the block, the water passing through the pores and emerging from the face to form a water film thereon from which tears drop, thereby simulating tearing activity. The eye nozzle are coupled to a miniature water reservoir disposed within the doll. The reservoir is subjected to air pressure by a compressible pneumatic actuator enclosed in a flexible arm of the doll, such that when the arm is squeezed, water forced into the eye nozzles to produce a tearing action.

12 Claims, 5 Drawing Sheets

Fig. 2.
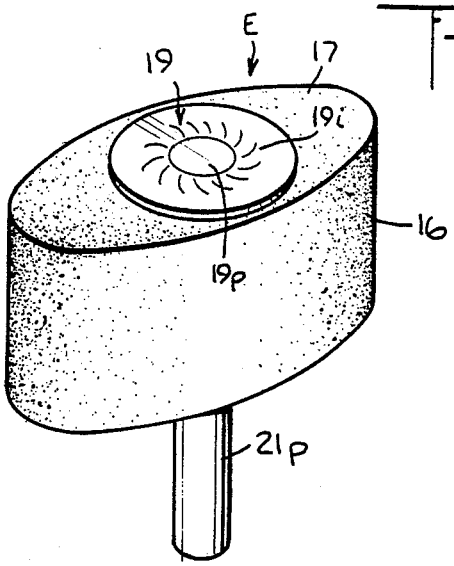
Fig. 3.
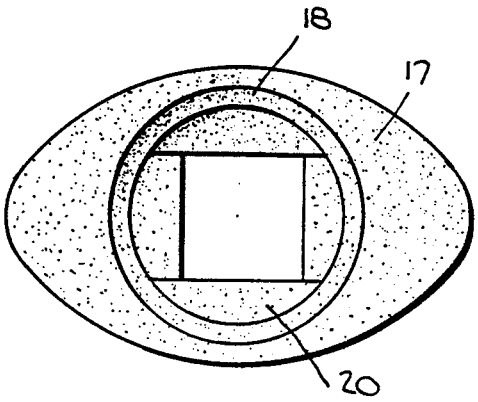
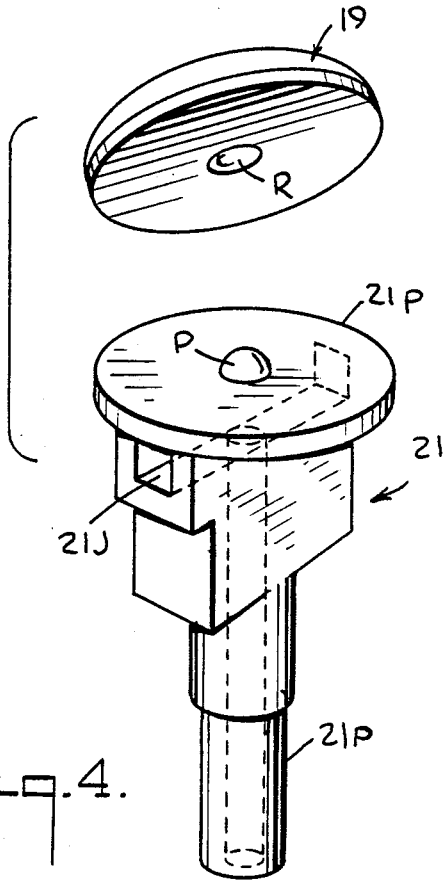
Fig. 4.
Fig. 5.
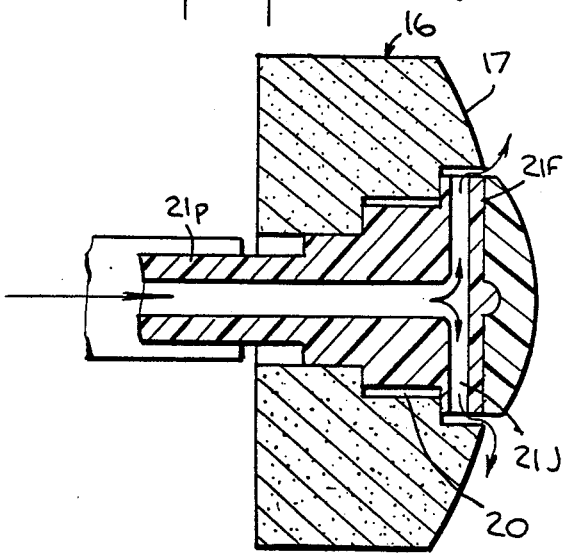

RESERVOIR
13
22
23
12
26
24
25
L2
L1
27
28
29

TEARING EYE DOLL

BACKGROUND OF INVENTION

1. Field of Invention:

This invention relates generally to dolls having synthetic eyes capable of simulating tearing activity, and more particularly to a tearing eye doll in which a liquid film is formed over the whites of the eyes and tears are dropped therefrom the create realistic tearing effects.

2. Status of Prior Art:

The human eye is a globular structure that is nested in a bony eye socket. Light is admitted through a transparent outer portion of the supporting globe, referred to as the cornea, the remainder being the white, opaque sclera. Light enters the pupil in the iris which is the colored part of the eye.

In a conventional synthetic eye for a doll, the pupil and iris are represented by a colored disc mounted on white surface which defines the sclera. While it is known to render synthetic eyes for dolls capable of tearing activity, such tearing eyes fail to produce realistic tearing effects.

A doll is often a surrogate for a human baby, and a child playing with a doll usually assumes the role of the baby's mother. Play acting performs an important role in child development, and the most effective dolls are those which simulate reality. This is why dolls which produce crying sounds are appealing, and why dolls capable of tearing also satisfy a child's need for verisimilitude.

Associated with the human eye are two tea ducts located in a corner of the eye socket. Tears keep the exposed part of the eye from drying, for drying would make clear vision impossible. Except when the eyes are closed, water continuously evaporates from the cornea, and the resultant dryness acts as a stimulus to evoke a winking reflex. The momentary closure of the eyes activates the tear ducts to cause liquid to be spread over the eye's surface. Hence in order to simulate in a synthetic eye realistic tearing activity, a water film covering the eye surface must be produced, so that tears well up from the synthetic eye and tears drop therefrom and not from a duct or other outlet displaced from the eye.

The patent to Hogan, U.S. Pat. No. 2,111,507, shows a primitive form of tearing eye doll having a hollow rubber casing, a water reservoir in the head of the doll being defined by a diaphragm. When the doll is squeezed, air pressure is applied to the diaphragm, which in turn imposes pressure on the water to force water through slits at the corners of the eye. The eyes are not covered by a water film and the tears do not well out of the eyes.

U.S. Pat. No. 2,196,912 to Gilbraith is somewhat more sophisticated in its water supply system. But tearing is effected by ejecting water from ducts adjacent the corners of synthetic eyes. In the Senior et al. U.S. Pat. No. 2,675,644, water is expelled through tear ducts adjacent the corners of the eyes. In the weeping doll shown in the patent to Ostrander, U.S. Pat. No. 2,811,810, the eyes are of glass and water is fed into the sockets of the eyes for discharge across the eyelids.

The Zanca et al. U.S. Pat. No. 2,812,615 produces tears by injecting water into a passage between a transparent plastic lens and an eye. In Cohn, U.S. Pat. No. 2,819,560, the weeping doll is provided with an opening to feed water over an eye held in a socket. Similarly, Ostrander, U.S. Pat. No. 2,959,890, supplies water into a clearance channel in the eye socket. Brudney, U.S. Pat. No. 3,019,551, provides a flexible duct for feeding water into an eye socket.

The patent to Cagen, U.S. Pat. No. 3,758,983, shows an elaborate arrangement for causing a doll to tear only in a horizontal position. The water comes out of the corners of the synthetic eyes, not from the eye itself. And in U.S. Pat. No. 4,339,889 to Guerrero it al., there is a motorized arrangement for ejecting water through a small opening in the eyes.

While all of the above-identified prior art patents produce tearing effects in synthetic eyes, these effects fail to simulate human eye tearing activity and are therefore lacking in realism.

SUMMARY OF INVENTION

In view of the foregoing, the main object of this invention is to provide a tearing eye doll having a pair of synthetic eyes which when a water supply system is actuated, are caused to tear, the whites of the eyes then being covered by a film of water from which tears drop to afford realistic tearing effects.

More particularly, an object of this invention is to provide synthetic eyes whose whites are formed by a porous eye-shaped block through whose pores water passes to emerge from the face of the block to create a water film thereon.

Also an object of this invention is to provide a tearing eye doll of the above type whose water supply system includes a miniature reservoir that is a replenished by inserting the spout of a squeeze bottle containing water into an inlet in the open mouth of the doll, whereby a child playing with the doll can bottle-feed the doll.

Still another object of the invention is to provide a tearing eye doll whose water supply system is acturated simply by squeezing an arm of the doll to cause the eyes of the doll to tear.

Yet another object of the invention is to provide a tearing eye doll having a water supply system disposed within the doll which is efficient and reliable in operation, and which when actuated feeds pressurized water to nozzles coupled to the synthetic eyes.

Briefly stated, these objects are accomplished in a tearing eye doll having a pair of synthetic eyes, each formed by an eye-shaped porous block whose face simulates the white of a human eye, and an impermeable disc seated in a recess in the face and colored to simulate an iris and a pupil therein. Received in a cavity within this block behind the disc is a nozzle for injecting water into the block, the water passing through the pores and emerging from the face to form a water film thereon from which tears drop, thereby simulating tearing activity. The eye nozzles are coupled to a miniature water reservoir disposed within the doll. The reservoir is subjected to air pressure by a compressible pneumatic actuator enclosed in a flexible arm of the doll, such that when the arm is squeezed, water is forced into the eye nozzles to produce a tearing action.

BRIEF DESCRIPTION OF DRAWINGS

For a better understanding of the invention as well as other objects and further features thereof, reference is made to the following detailed description to be read in conjunction with the accompanying drawings, wherein:

FIG. 2 is a perspective view of one of the synthetic eyes includes in the doll, the eye being composed of an eye-shaped block and a disc mounted in a central recess in the face of the block to define the colored iris and pupil of the eye;

FIG. 3 is a front view of the block showing the face thereof with the disc removed;

FIG. 4 is a perspective view of the nozzle and of the iris-pupil disc which overlies the nozzle;

FIG. 5 is a section taken through the synthetic eye, with a nozzle installed therein for injecting water into the porous block;

DESCRIPTION OF INVENTION

Figure 1:
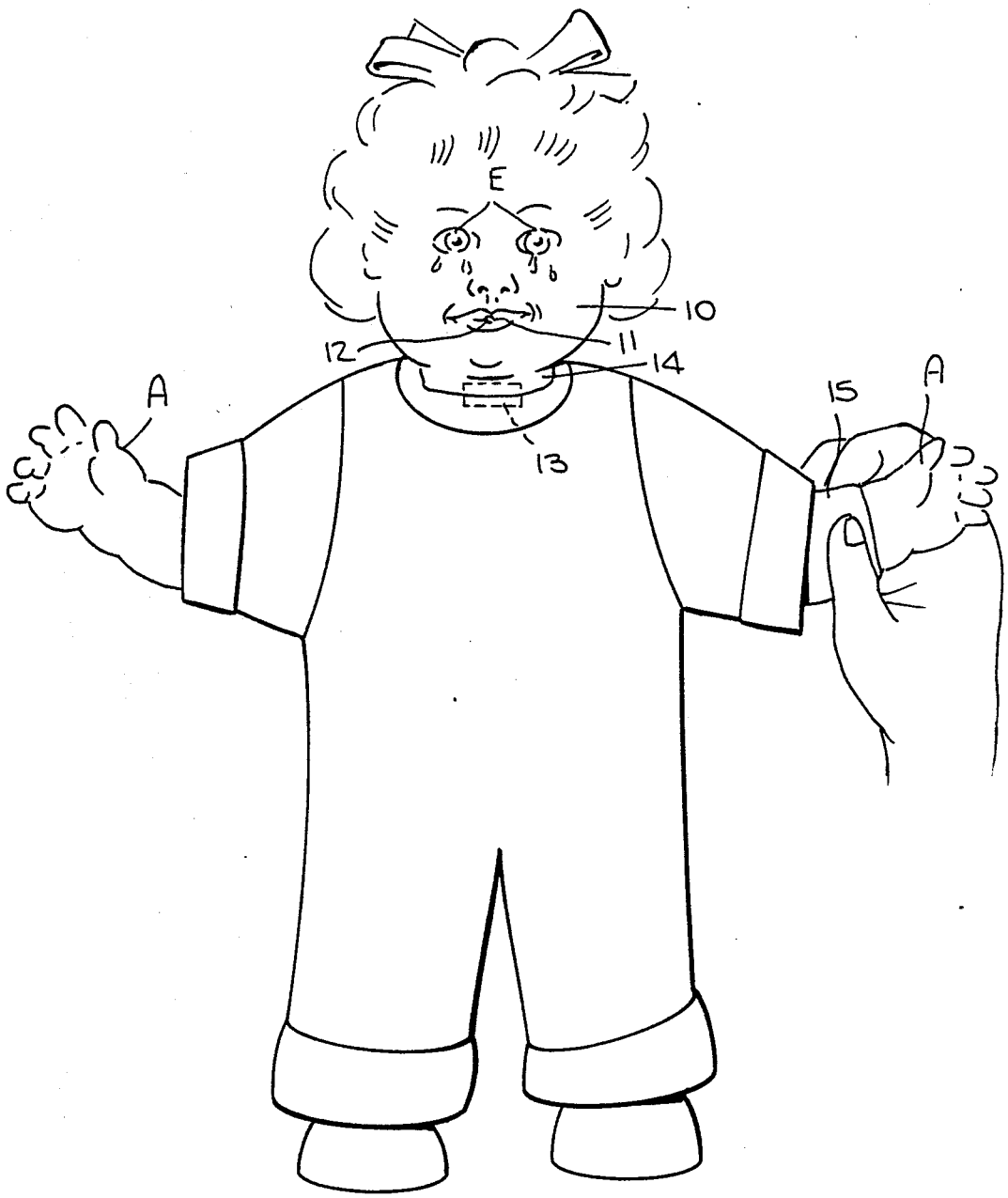
FIG. 1 is a perspective view of a tearing eye doll in accordance with the invention.

The Tearing Eye Doll:

Referring now to FIG. 1, there is shown a tearing eye doll in accordance with the invention whose head 10 is provided with sockets in which are nested synthetic eyes E. The doll head has an open mouth 11 which exposes the inlet 12 of an inlet and valve assembly coupled by air and water lines to the miniature water reservoir 13 of a water supply system.

Reservoir 13, which is indicated by dashed lines, is placed within the neck 14 of the doll. The doll is provided with a pair of hollow arms A molded of flexible plastic material. Disposed within one of these arms is a compressible pneumatic actuator 15 as a squeeze bulb or air pump. In practice, the flexible arm itself may be internally closed to define a pneumatic actuator.

Actuator 15 is coupled by an air line to reservoir 13 whereby when the arm containing the actuator is squeezed to operate the actuator, this action imposes a positive air pressure on the water in reservoir 13 to force water from the reservoir through a water line leading to nozzles associated with eyes E to produce a tearing action in a manner to be later described. The details of the water supply system which includes reservoir 13 and pneumatic actuator 15 will be described in a subsequent section.

The Synthetic Eye:

Referring now to FIGS. 2 to 5, each synthetic eye E is composed of an eye-shaped block 16 of porous white material which in practice may be a porous ceramic or a porous polyethylene body, or other foraminous material. Block 16 includes a slightly convex face 17 having a circular recess 18 therein within which is seated an impermeable plastic disc 19. Disc 19 is colored to simulate an iris 19*i* and a pupil 19*p*, the outer surface of disc 19 being slightly convex as in a natural eye.

Received in a cavity 20 formed centrally in block 16 behind disc 19 is a nozzle generally defined by numeral 21, having a circular top flange 21*f* provided with a center pimple P that fits into a complementary recess R formed in the underside of disc 19. Thus when the disc in the recess is bonded to the block, it acts to maintain the nozzle in position.

Flange 21F overlies diametrically-opposed jet openings 21J which are supplied with pressurized water through an input pipe 21P. Thus when the input pipe is fed with pressurized water from reservoir 13, the water is projected in opposite directions from jet openings 21J to impinge on the wall of the cavity in block 16, the water passing through the pores in this block to emerge from the convex face 17. The water spreads across the surface of this face to form a film from which tears drop in a realistic manner, as shown in FIG. 1.

Because the pressurized water is applied in opposite directions to the wall of the cavity in the block, the water is distributed throughout the pores of the block and the water film formed on the face of the block surrounding the impermeable disc is substantially uniform. The amount of pressure applied by a player to acturator 15 determines the extend of tearing, so that the player can produce a slight film on the eyes to render it moist, or she can make the eyes produce copious tear drops.

Figures 6, 9:
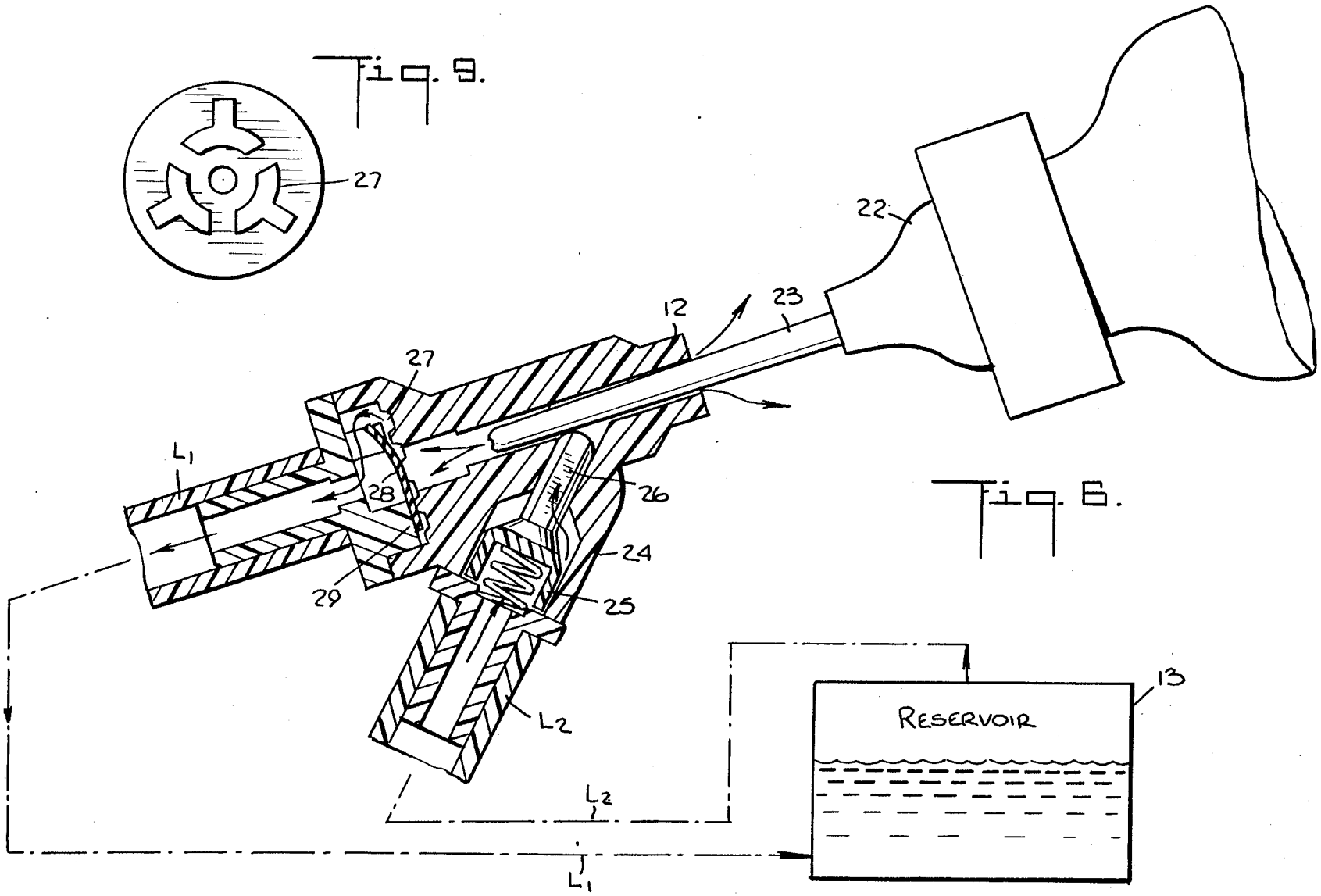
FIG. 6 illustrates the mouth inlet and valve assembly, with the spout of the water bottle inserted into the inlet to replenish the water in the reservoir of the water supply system.
FIG. 9 is a plan view of the seat of the inlet valve
Figures 7, 8:
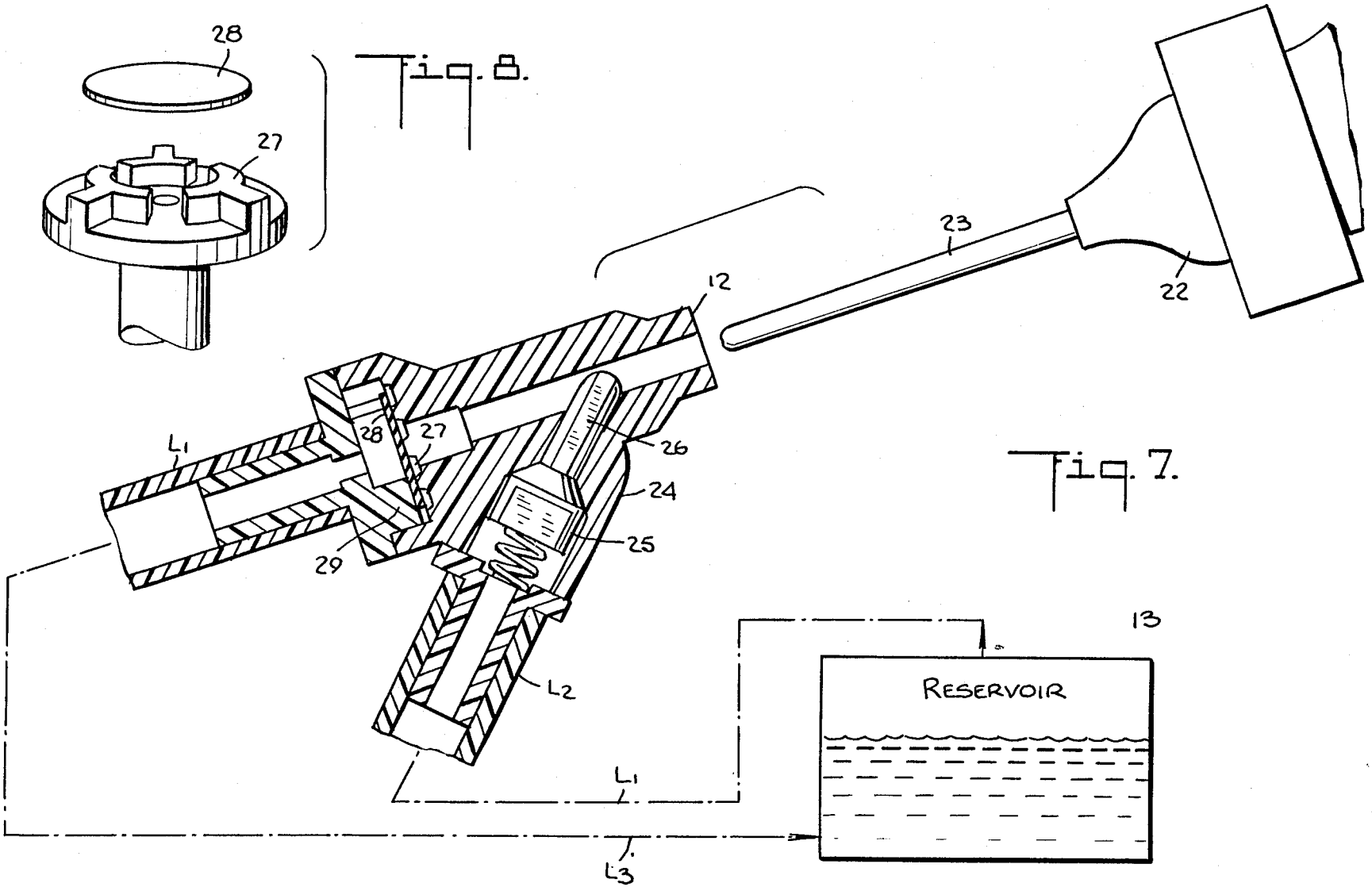
FIG. 7 is similar to FIG. 6, except that the spout is withdrawn from the inlet.
FIG. 8 is an exploded view of one-way valve elements included in the inlet.

Bottle Feeding:

Referring now to FIGS. 6 and 7, there is shown a plastic squeeze bottle 22 filled with water and having a long tapered spout 23 which is inserted into the inlet 12 in the open mouth of the doll. Inlet 12 is coupled by a water line $L_1$ extending to reservoir 13 of the water supply system. Reservoir 13 is coupled by an air vent line $L_2$ to a one-way valve 24 which is joined at an angle to inlet 12, the inlet and valve forming a unitary assembly.

Valve 24 is provided with a spring-biased valve 25 having a conical head an an acturator pin 26 extending axially therefrom. This pin is intercepted and axially shifted by spout 23 when, as shown in FIG. 6, the spout is inserted in inlet 12. This action serves to displace the conical head from its complementary conical seat and to open valve 25 to vent reservoir 13 to the atmosphere when water is being fed into the reservoir and in doing so, displaces air. But when spout 23 is withdrawn from the inlet as shown in FIG. 7, then valve 25 closes, and the reservoir is then hermetically sealed.

Inlet 12 is provided with a one-way valve formed by a valve seat 27, shown separately in FIGS. 8 and 9, having a circular array of arcuate segments over which lies a disc-shaped diaphragm 28 which is clamped to one side of the seat by a post 29 so that the other side is free to deflect. Hence when as shown in FIG. 6, water is injected into inlet 12 by bottle 22 through spout 23, the resultant pressure deflects diaphragm 27 to open the valve and admit the water in line $L_1$ leading to reservoir 13, the air then displaced from the reservoir being vented into the atmosphere through air vent line $L_2$. When, as shown in FIG. 7, spout 23 is withdrawn from the inlet, the action causes the water inlet valve 27, 28 to close and also causes the air vent valve 24 to close, thereby sealing the reservoir.

Figure 11:
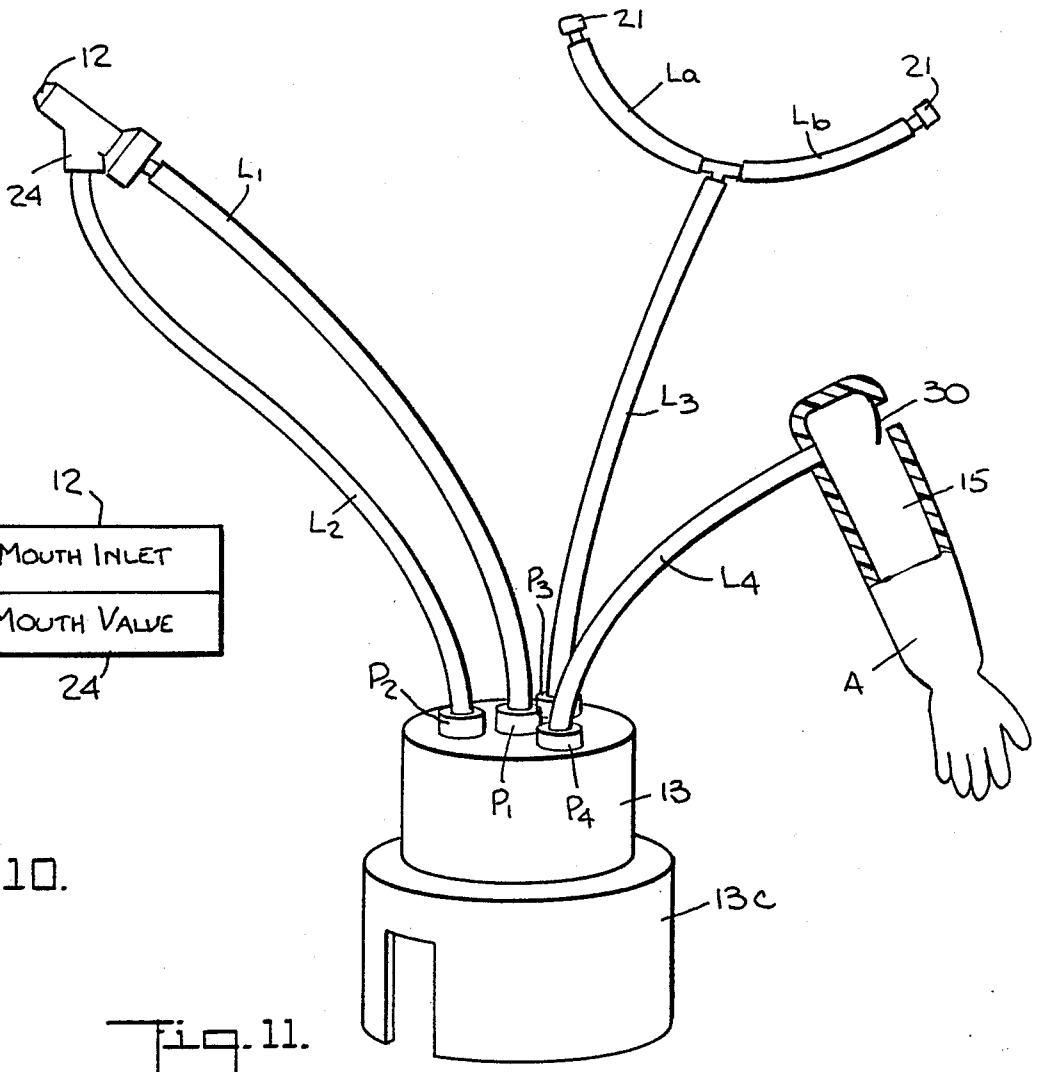
FIG. 11 shows an actural embodiment of the water supply system for the tearing eyes.
Figure 10:
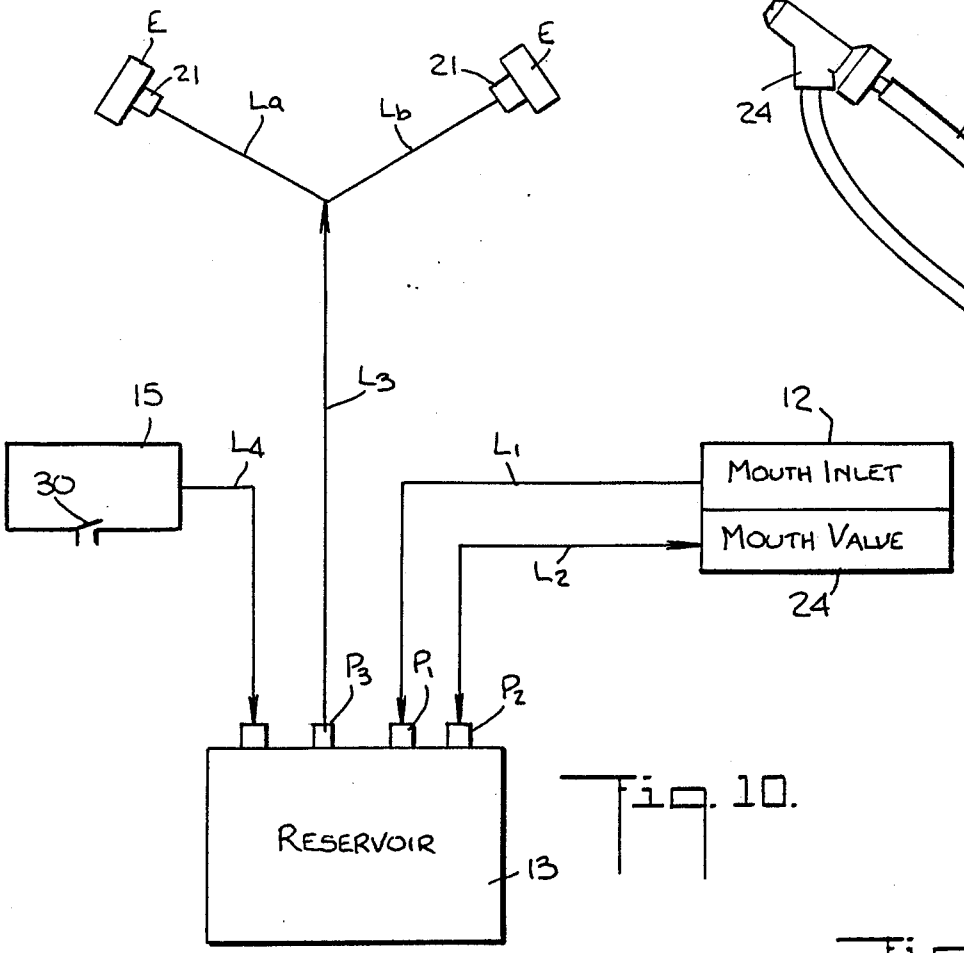
FIG. 10 is a schematic diagram of the water supply system.

The Water Supply System:

Referring now to FIGS. 10 and 11, the complete water supply system is shown as it functions to supply water to nozzles 21 associated with the synthetic eyes E of the doll. It will be seen that reservoir 13, which is a miniature circular tank, is mounted on a supporting collar 13C which is received in the neck of the doll.

Reservoir 13 is provided at its upper end with ports $P_1$, $P_2$, $P_3$ and $P_4$. Port $P_1$ is coupled by water line $L_1$, which is in the form of a flexible plastic tube, to mouth water inlet 12, while port $P_2$ is coupled by an air vent line $L_2$, also in the form of a flexible tube, to the mouth air vent valve 24.

When, therefore, the spout of the water bottle is inserted in mouth inlet 12 to feed water into the reservoir, air vent valve 24 is opened by the inserted spout to vent air displaced from the reservoir as it is being filled. The air vent valve is closed automatically when the spout is withdrawn from the inlet. The one-way valve included in water inlet 12 (not shown in FIGS. 10 and 11) is caused to open when the spout is inserted and closes when the spout is withdrawn.

Port $P_3$ is coupled by a main water line $L_3$ to nozzles 21 by way of branch lines $L_a$ and $L_b$. Port $P_4$ is coupled by air line $L_4$ to compressible pneumatic actuator 15 which is provided with one-way outlet valve 30 which is closed when acturator 15 is compressed to force air into reservoir 13 to produce a positive pressure, thereby causing water from the reservoir to supply nozzles 21 through line $L_3$. When actuator 15 is released, the resultant negative pressure causes air valve 30 to open to admit air into the actuator.

Thus no component of the water supply system is exposed, other than the small inlet in the open mouth of the doll, and the manner in which tearing takes place is concealed. In most cases, only the player knows that the tearing action is controlled simply by squeezing one arm of the doll, and the child playing with the doll can mystify and thereby impress others who see the doll tear on command without knowing why.

While there has been shown and described a preferred embodiment of a tearing eye doll in accordance with the invention, it will be appreciated that many changes and modifications may be made therein without, however, departing from the essential spirit thereof. Thus the pneumatic actuator need not be located in an arm of the doll, but may be placed in the body or in a leg or at any other site accessible to the user.

We claim:

1. A tearing eye doll comprising:

(a) a head having a pair of synthetic eyes socketed therein, each being formed by an eye-shaped porous block having a face which simulates the white of a human eye and an impermeable disc seated in a recess in the face, said disc having an outward fall and being colored to simulate an iris and a pupil therein;

(b) a nozzle received in a cavity in said block behind the disc for injecting water into the block, the water passing through pores of the block and emerging from the face thereof to form a water film thereon from which tears drop; and (c) means including an actuator to force water from a reservoir disposed in said doll to said nozzle only when said actuator is operated.

2. A doll as set forth in claim 1, wherein the face of the block and the face of the disc are slightly convex to simulate a natural eye.

3. A doll as set forth in claim 1, wherein said block is formed of porous polyethylene material.

4. A doll as set forth in claim 1, wherein said actuator is a pneumatic actuator.

5. A doll as set forth in claim 4, wherein said doll is provided with a hollow arm of flexible material and said actuator is a compressible bulb disposed in said arm which is operated when the arm is squeezed.

6. A doll as set forth in claim 4, further including an air valve to admit air into said actuator when it is released to create a negative pressure.

7. A doll as set forth in claim 1, wherein said reservoir is disposed in the neck of the doll.

8. A doll as set for the in claim 1, further including means to replenish the water in said reservoir.

9. A doll as set forth in claim 8, wherein said means is constituted by an inlet in the mouth of the doll into which one can feed water, said inlet being coupled to said reservoir, and an air valve which is actuated when water is being fed into the reservoir to then vent the reservoir to discharge air displaced therefrom.

10. A doll as set forth in claim 9, wherein said inlet is jointed to said air valve which is provided with a valve actuator pin that is intercepted by a spout inserted in the inlet to feed water therein to then open the air valve, the air valve being closed when the spout is withdrawn.

11. A synthetic eye for a tearing doll comprising:

(a) an eye-shaped block of porous material having a white face to simulate the sclera of a natural eye and a disc mounted on the face which is colored to simulate the iris and pupil of a natural eye, said block having a cavity therein behind the disc; and (b) means disposed in said cavity to inject pressurized fluid into the block to cause the fluid to pass through pores of the block and form a liquid film on the face thereof from which tears drop.

12. An eye as set forth in claim 11, wherein said means is constituted by a nozzle which projects the liquid in opposing directions to impinge on the wall of the cavity.

* * * * *

UNITED STATES PATENT AND TRADEMARK OFFICE

CERTIFICATE OF CORRECTION

PATENT NO. : 4,900,287

DATED : February 13, 1990

INVENTOR(S) : John C. Fusi and Robert M. Jensen

It is certified that error appears in the above-identified patent and that said Letters Patent is hereby corrected as shown below:

Column 5, line 50 "fall" should read --face--.

Column 6, line 34, "jointed" should read --joined--.

Signed and Sealed this

Eighth Day of January, 1991

*Attest:*

*Attesting Officer*

HARRY F. MANBECK, JR.

*Commissioner of Patents and Trademarks*